United States Patent [19]

Lurkis et al.

[11] Patent Number: 5,022,562

[45] Date of Patent: Jun. 11, 1991

[54] COMBINATION PROTECTIVE CAP AND VALVE OPENER

[76] Inventors: Jeffry L. Lurkis, 7626 Willow Glen Rd., Los Angeles, Calif. 90046; Stanley B. Solomon, 29 Misty Acres Rd., Rolling Hills Estates, Calif. 90274

[21] Appl. No.: 378,802

[22] Filed: Jul. 11, 1989

[51] Int. Cl.[5] ..... B67D 5/06

[52] U.S. Cl. ..... 222/182; 222/525; 220/85 P; 220/256; 220/260

[58] Field of Search ..... 222/522, 523, 524, 525, 222/543, 562, 182, 212; 220/256, 345, 85 P, 260; 251/155

[56] References Cited

U.S. PATENT DOCUMENTS

| | | | |
|---|---|---|---|
| 3,066,834 | 12/1962 | Kingsbury | 222/215 |
| 3,204,827 | 9/1965 | Krautkrämer | 222/143 |
| 3,407,956 | 10/1968 | Linkletter et al. | 215/41 |
| 3,489,323 | 1/1970 | Hug | 222/402.16 |
| 3,738,545 | 6/1973 | Roy | 222/525 |

*Primary Examiner*—Michael S. Huppert
*Assistant Examiner*—Anthoula Pomrening
*Attorney, Agent, or Firm*—Kelly, Bauersfeld & Lowry

[57] ABSTRACT

This invention describes a cap for use with a poppet valve of the type having a movable poppet plunger for controlling the dispensing of liquids from a bottle. The cap is a unitary molded member having a centrally located cylindrical opening at only one end. The inside diameter is adapted to contact a top portion of the movable poppet plunger whereby inserting or removing the cap over the poppet valve opens or closes the poppet plunger respectively. A circular ring attached to the top of the cap at a position located over the closed end of the cylindrical opening allows the user to remove the cap and open the poppet valve with a single movement. Similarly, replacing the cap on the poppet valve automatically closes the poppet valve in a single motion.

4 Claims, 2 Drawing Sheets

Fig. 7.
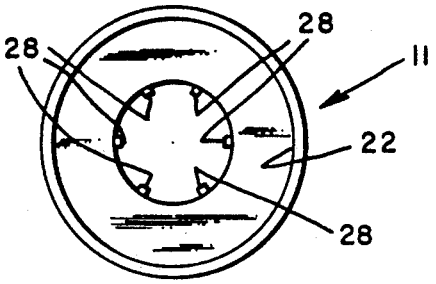
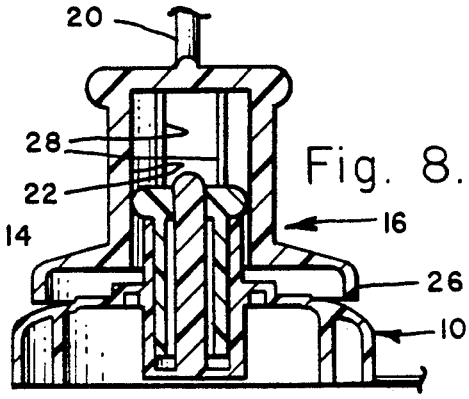
Fig. 8.
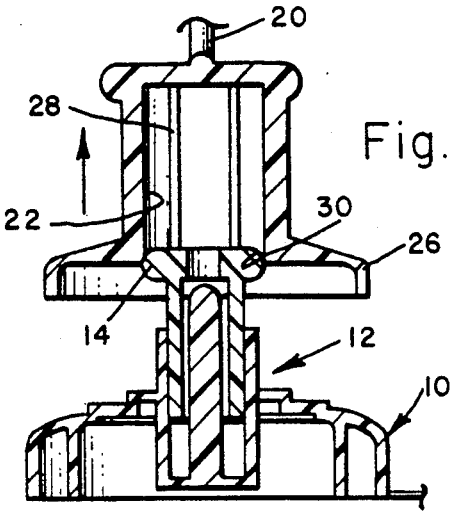
Fig. 9.
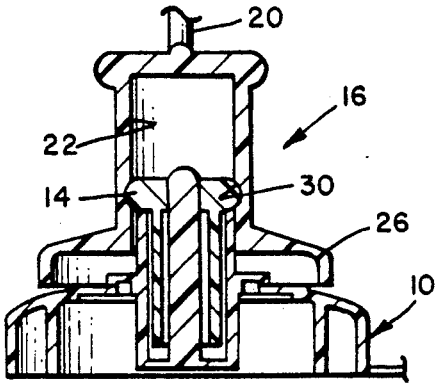
Fig. 11.
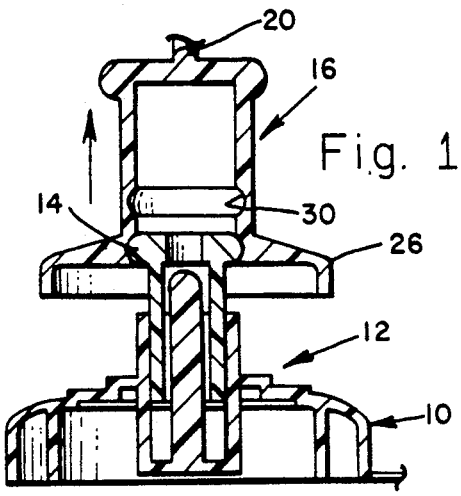
Fig. 10.
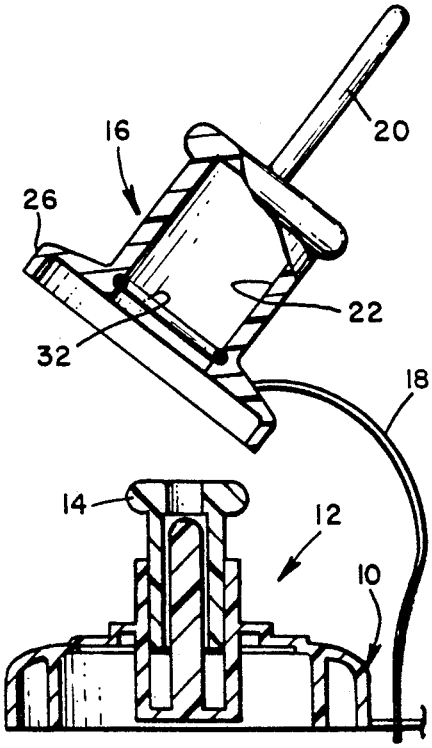
Fig. 12.
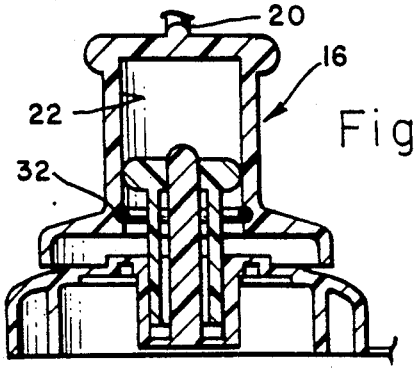
Fig. 13.

COMBINATION PROTECTIVE CAP AND VALVE OPENER

This invention relates to a protective cap adapted to fit over a poppet valve and more particularly to a protective cap capable of closing the poppet plunger associated with the poppet valve when the cap is inserted on the valve and opening the poppet plunge when the cap is removed from the valve.

A poppet valve is a state of the art valve commonly used on bottles for dispensing fluids. The poppet valve contains a poppet plunger that is adapted to move in an axial direction in the valve so as to open or close and thereby control the flow of liquid in the bottle depending only on the position of the poppet plunger.

In the art as practiced today, a conventional cap is placed over the poppet valve in order to protect the valve from the environment In this way the valve is kept clean until ready for use by the user. When needed, the user first removes the protective cap and then pulls out the poppet plunger in order to allow fluid located within the bottle to be dispensed.

Bottles containing poppet valves have become extremely popular with bicycle and motorcycle riders as a means of carrying and dispensing water or other liquids during a race. In such situations the rider can only use a single hand to remove the protective cap and then open the poppet plunger, a difficult feat at best.

Unfortunately, an easily removable cap capable of protecting the poppet valve from the environment and simultaneously opening the poppet plunger in one motion has not been available until the advent of the present invention. Until now, poppet valves without protection would become contaminated by dirt and road grime at the time the rider wanted a drink. If a presently available cover was inserted over the poppet valve, the rider would have to go through a two step process of first removing the cap and then opening the poppet valve, a difficult feat at best while riding a bike.

Because of the simplicity of the poppet valve, the manufacturers of water bottles have almost universally adopted the poppet valve for water bottles thereby making it mandatory for the rider to have some means of protecting the poppet valve from the environment before he attempts to take a drink.

A review of the prior art does not disclose a protective cap specifically designed for a poppet valve; however the art does . show many different valves and means for protecting the pouring spout from contamination. For example U.S. Des. No. 268,722 to Bova shows a Pull Cap for sealing and covering the spout while U.S. Des. No. 206,971 to Williams shows a Combined Cap for sealing and covering the spout.

In a similar fashion U.S. Pat. No. 191,295 to Arnold shows a stopper with a ring attached while U.S. Pat. No. 3,235,117 to Mason shows a plastic closure that covers and seals the pouring spout.

U.S. Pat. No. 524,159 to Birnbaum illustrates a tethered bottle cover that protects the opening of a bottle from dirt and grime; however, there is no valve present and once the cover is removed the contents are exposed to the atmosphere. U.S. Des. No. 226,555 to Weber illustrates a Bottle Cap of novel design that is adapted to be placed over a valve of some kind. Unfortunately, the defined cover does interact with the valve and is used only to protect the valve and not to open or close the valve as is shown in the present invention. Other patents such as U.S. Pat. No. 3,750,820 to Labarre and U.S. Des. No. 278,414 to Cho and even U.S. Pat. No. 3,407,956 to Linkletter simply show other forms of bottle stoppers or covers but none having the dual function of the present invention.

These prior art patents usually perform the singular function of either opening the pouring spout or covering the valve controlling the spout. In some cases the cover is the valve and in other cases the cover simply covers the valve.

In the present invention the cap performs the dual functions of covering the spout area from dirt and grime and at the same time opening the poppet plunger when the cap is removed. Similarly replacing the cap on the poppet valve automatically closes the poppet plunger thereby protecting the valve and the spout area from dirt and grime.

The present cap is constructed of a unitary conformable member preferably plastic and with a centrally located cylindrical opening that is closed at one end and opened at the other. The inside diameter of the cylinder approximates that of the diameter of the head of a conventional poppet valve plunger associated with a poppet valve.

A portion of the inside diameter of the cylindrical opening is adapted to contact the head of the poppet plunger thereby allowing the poppet plunger to open and close whenever the cap is removed or inserted from the poppet valve. A shoulder portion located on the cap in the area of the open cylinder is adapted to engage in a sealing relationship with the bottle holding the poppet valve. A ring is usually attached to the top of the cap at a position located over the closed end of the cylindrical opening to facilitate the removal and insertion of the cap onto or off the poppet valve.

Further objects and advantages will be made more apparent as the description progresses, reference now being made to the accompanying drawings wherein;

FIG. 7 is a bottom view of the protective cap illustrating a first embodiment for operating the poppet plunger;

FIG. 8 is a cross-sectional view of FIG. 7 taken along lines 8—8 illustrating the cap on the poppet valve with the poppet plunger closed;

FIG. 9 is a cross-sectional view similar to that illustrated in FIG. 8 which illustrates the poppet valve in an open position;

FIG. 10 is a sectional view illustrating a second embodiment of the cap over the poppet valve with the poppet plunger in an open position;

FIG. 11 is a view similar to that illustrated in FIG. 10 which illustrates the poppet plunger in a closed position;

FIG. 12 illustrates a sectional view of a third embodiment of the cap showing the poppet plunger in an open position;

FIG. 13 is a cross-sectional view similar to FIG. 12 which shows the poppet plunger in a closed position.

Figure 1:
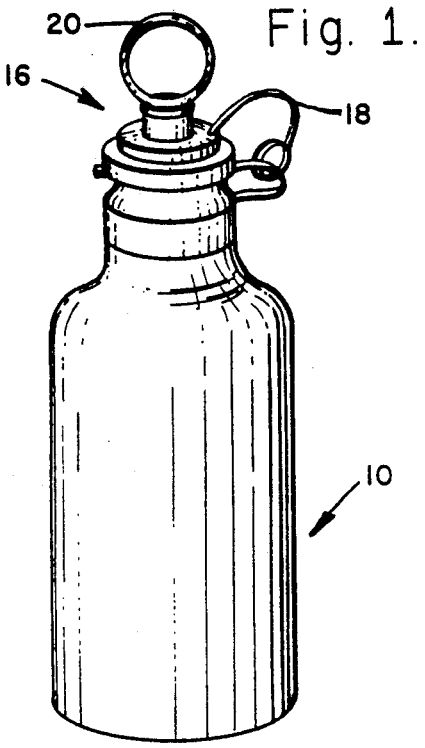
FIG. 1 illustrates a water bottle having a poppet valve covered by a protective cap constructed according to the present invention.
Figure 2:
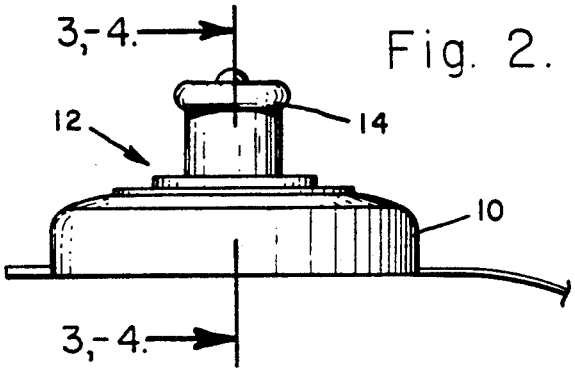
FIG. 2 is a partial view of the poppet valve illustrated in FIG. 1 but without the protective cap.

Referring now to FIGS. 1 and 2, there is shown a water bottle 10 containing a poppet valve 12 having a poppet plunger 14 for opening and closing the valve. A cap 16 is tethered to the bottle by means of a loop 18 and contains a ring 20 on the uppermost part for removing the cap 16 from the poppet valve 12.

The inventive concept concerns a new and novel cap 16 having the ability to open the poppet plunger 14 when the cap is removed and similarly to close the poppet plunger when the cap is replaced over the poppet valve 12.

Figure 3:
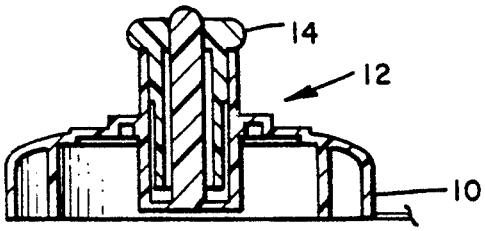
FIG. 3 is a cross-sectional view taken along lines 3—3 of FIG. 2 illustrating the poppet plunger in a closed position.

Referring now to FIG. 3, there is shown a cross-sectional view of FIG. 2 taken along lines 3—3 which illustrates the poppet valve 12 located on the bottle 10 and which illustrates the poppet plunger 14 in a closed position. In the position as illustrated, the fluid located within the bottle 10 cannot exit through the poppet valve 12 because of the sealing action of the poppet plunger 14.

Figure 4:
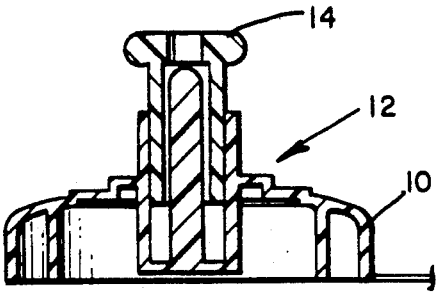
FIG. 4 is a cross-sectional view of FIG. 2 taken along lines 4—4 showing the poppet plunger in an open position.

Referring now to FIG. 4, there is shown a cross-sectional view taken along lines 4—4 in FIG. 2 which illustrates the poppet plunger 14 associated with the valve 12 in an open position. In this position, water located within the bottle 10 can pass through the poppet valve 12 and exit to the outside. In this position the fluid passageway is open and the fluid can easily be removed by tipping the bottle 10.

Figure 5:
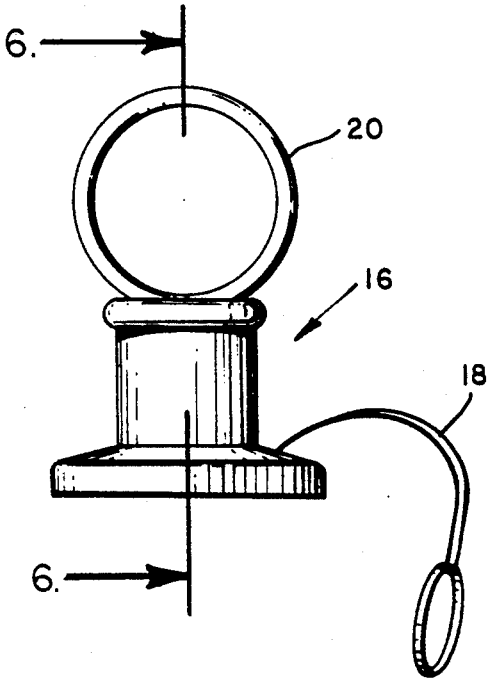
FIG. 5 is a side elevational view of the poppet valve illustrating a tethered ring and pull ring.

Referring now to FIG. 5, there is shown a side elevational view of the cap 16 having a pull ring 20 located on the uppermost portion and a tether 18 adapted to be connected at the opposite end to the bottle portion 10 illustrated in FIGS. 1 and 2.

Figure 6:
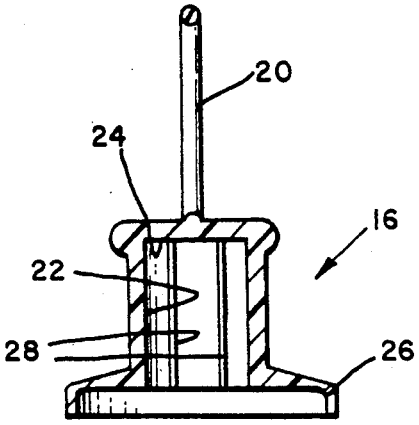
FIG. 6 is a cross-sectional view taken along lines 6—6 of FIG. 5.

FIG. 6 is a cross-sectional view of FIG. 5 taken along lines 6—6 and more fully illustrates the internal construction of the cap 16. The cap 16 is constructed of a unitary molded conformable plastic material having a centrally located cylindrical opening 22 that is closed at the upper end 24 and which is opened at the opposite end.

The cap 16 contains a shoulder portion 26 located near the open end of the cylinder 22 and which is adapted to engage in the sealing relationship with the bottle 10 illustrated in FIGS. 1 and 2. In this fashion the cap 16 completely protects the poppet valve 12 illustrated in FIG. 2 from any dirt or grime in the area.

A plurality of ribs 28 are located on the internal wall of cylinder 22 and located axially with respect to the cylinder 22.

In the preferred embodiment, there are six ribs 28 equally located on the internal wall of the cylinder. The size of the ribs is chosen so that the reduced internal diameter of the cylinder wall 22 caused by the ribs 28 is less than the diameter of the plunger 14 illustrated in FIG. 2. In this way moving the cap 16 over the plunger valve 12 allows the ribs 28 to frictionally engage the valve plunger 14 and thereby cause the plunger to move as the cap 16 is moved.

In other words, placing the cap 16 on the poppet valve 12 of FIG. 2 causes the ribs 16 to contact the poppet plunger 14 thereby pushing the poppet plunger into a closed position by the simple act of placing the cap on the valve. Similarly, removing the cap 16 from the poppet valve 12 causes the ribs 28 to frictionally engage poppet plunger 14 thereby pulling the poppet plunger into an open position whenever the cap is removed from the valve.

Referring now to FIG. 7, there is shown a bottom view of the cap 16 more fully illustrating the ribs 28 located on the internal surface of the cylinder 22.

Referring now to FIG. 8, there is shown a cross-sectional view taken along lines 8—8 of FIG. 7, showing the cap 16 placed on the bottle 10. In this position the ribs 28 located on the internal wall of the cylinder 22 have frictionally engaged the valve plunger 14 causing the valve plunger to be inserted within the plunger valve 12.

It can be appreciated therefore that whenever the user replaces the cap 16 on the valve 12 that the frictional contact between internal ribs 28 contacting the valve plunger 14 will push the valve plunger into a down and close position, thereby sealing the poppet valve 12 by the simple act of replacing the cap 16 onto the poppet valve.

Referring now to FIG. 9, there is shown a cross-sectional view similar to that illustrated in connection with FIG. 8, but now showing the cap 16 being removed from the poppet valve 12 located on the bottle 10. In this position the ribs 28 located on the internal wall of the cylinder 22 have frictionally contacted the poppet plunger 14 thereby causing the poppet plunger to be opened as the cap 16 is removed. In this position the poppet valve 12 is now open and fluid within the bottle 10 can be easily dispensed. It can be appreciated therefore that simply removing the cap 16 automatically opens the poppet valve.

The main thrust of the present invention concerns an application of causing a portion of the internal wall 22 of the cap 16 to contact the poppet plunger 14 associated with the poppet valve 12. The invention is concerned with three different embodiments for developing this frictional contact. In the first embodiment, ribs 28 attached to the internal cylinder wall 22 caused the contact.

Referring now to FIG. 10, there is shown a second embodiment of the invention which allows the internal wall of the cap to contact the poppet plunger.

FIG. 10 is a cross-sectional view of the cap 16 and valve 12 located on bottle 10 similar to that shown in FIG. 9. FIG. 10 shows the cap 16 removed from the poppet valve 12. FIG. 10 illustrates a second embodiment of the invention which allows a portion of the internal cylinder diameter 22 to contact the top portion of the poppet plunger 14. The internal diameter of the cylindrical opening 22 is chosen to just approximate the diameter of the pop top of the poppet plunger 14. Located on the bottommost portion of the cylinder 22 is an indent in the form of a torus 30 approximating the shape of the top of the poppet valve plunger 14. The torus shape indent 30 located within the cylinder 22 is adapted to allow the head of the poppet plunger 14 to nest within the torus shape thereby allowing the torus to move the poppet plunger as the cap 16 is moved. In the position shown the cap 16 has been removed from the poppet valve 12 and the poppet plunger 14 has been released from the torus 30 located on the internal cylinder wall 22. In this fashion removing the cap 16 opens the poppet valve 14 associated with the poppet valve 12.

Referring now to FIG. 11, there is shown a cross-sectional view similar to that shown in connection with FIG. 8 which shows the second embodiment of the invention as illustrated in FIG. 10 with the cap 16 in a closed position over the bottle 10. In this position the torus indent 30 located on the internal cylinder wall 22 completely encompasses the top of the poppet plunger 14 thereby allowing the poppet plunger to nest within the torus indent. In this position replacing the cap 16 onto the bottle 10 causes the poppet plunger to be located within the torus member 30 and causes the poppet plunger to close as the cap 16 is replaced onto the bottle 10.

The invention also describes still a third embodiment for insuring that the internal diameter of the cylinder 22 will contact the top of the poppet plunger 14 associated with the poppet valve 12.

The cap described in this invention is adapted to fit with poppet valves manufactured by a plurality of different manufacturers. Unfortunately, each manufacturer uses different specifications and diameters for his poppet valves and for his poppet plunger. All poppet valves must by definition contain a poppet plunger that opens and closes the poppet valve, however the diameter of the head of the poppet plunger is not always the same and is not always greater than the diameter of the cylinder wall comprising the poppet valve itself.

The third embodiment of the present invention is intended to insure that the defined cap will operate with all poppet plungers regardless of the diameter of the head of the poppet plunger associated with the poppet valve.

Referring now to FIG. 12, there is shown a cap 16 in the position removed from the bottle 10 and with the poppet plunger 14 in an open position. The cap is shown tethered to the bottle by means of tether 18.

In the third embodiment the internal diameter of the cylinder 22 is chosen to approximate the diameter of the poppet valve 12. Located on the bottommost portion of the cylinder 22 is an O-ring 32 fixedly attached to the internal wall of cylinder 22 and which is adapted to restrict the diameter to a diameter that is less than the diameter of the poppet valve 12. In this fashion placing the cap 16 onto the poppet valve 12 will insure that the head of the poppet plunger 14 will contact the O-ring 32 thereby causing the poppet plunger 14 to be closed when the cap 16 is inserted on the poppet valve 12 or to be opened when the cap 16 is removed. Since the internal diameter of the O-ring 32 is less than the diameter of the head portion of the poppet plunger 14, it will be appreciated that inserting the cap 16 onto the bottle 10 will insure that the poppet plunger is closed at the same time the cap is replaced.

Referring now to FIG. 13, there is shown a cross-sectional view of the third embodiment of the invention similar to that illustrated in connection with FIG. 12. FIG. 13 shows the cap 16 located over the bottle 12 in a sealing relationship. As mentioned previously the internal diameter of the O-ring 32 is less than the diameter of the poppet plunger 14, thereby insuring that the O-ring 32 will force the poppet plunger into a closed position when the cap 16 is placed on the bottle 10.

In the position as shown in FIG. 13, the cap 16 has been placed in a sealing relationship on the bottle, and the O-ring 32 has been forced over the head of the poppet plunger 14 as illustrated.

It will be appreciated therefore that when the cap 16 is removed as shown in FIG. 12, that the O-ring 32 will contact the bottommost portion of the head of the poppet plunger 14 thereby opening the plunger as the cap is removed.

In reviewing the drawings illustrating the three embodiments of the present invention, it will be appreciated that the internal diameters and dimensions have been exaggerated in order to illustrate the function of the internal diameter of the cap as it cooperates with the head of the valve plunger. In all cases, however, a portion of the cylindrical opening is adapted to contact the poppet plunger thereby insuring movement of the poppet plunger whenever the cap is inserted or removed from the bottle.

The present invention is therefore useful in all hostile environments where the dispensing of a liquid is required and where the full use of both hands is limited.

We claim:

1. A protective cap for use in combination with a bottle having an upper surface, and a poppet valve assembly mounted on said upper surface, said poppet valve assembly including a valve plunger projecting upwardly therefrom above said upper surface and vertically movable between a raised open position and a lowered closed position for respectively permitting and preventing dispensing of a liquid within said bottle through said poppet valve assembly, said protective cap comprising:

a generally cylindrical cap member having an upper closed end and a lower open end, said cap member having an inner diametric size for frictionally engaging a portion of said poppet plunger when said poppet plunger is received into said cap member;

a shoulder flange projecting radially outwardly from said lower open end of said cap member, said shoulder flange including a seal lip disposed generally at the outer periphery thereof and turned in a direction for engaging said upper surface of said bottle when said plunger is received into said cap member;

tether means for flexibly connecting said protective cap to said bottle; and pull ring means projecting generally upwardly from said upper end of said cap member, whereby said protective cap is manipulatable in a one-handed operation while holding said bottle with the same hand to lift said cap member by pulling upwardly on said pull ring means so that said cap member frictionally engages said poppet plunger and moves said poppet plunger from said closed position to said open position and then separates from said poppet plunger, and to move said poppet plunger from said open position to said closed position by pressing said cap member onto and over said poppet plunger to frictionally engage said poppet plunger and to move said shoulder flange to a position with said seal lip engaging said bottle upper surface about said poppet valve assembly.

2. The combination of claim 1 wherein said cap member, said shoulder flange, and said pull ring means comprise a unitary molding of resilient plastic material.

3. The combination of claim 2 wherein said tether means is formed integrally with said cap member, shoulder flange and pull ring means.

4. The combination of claim 1 wherein said cap member includes radially inwardly protruding rib means formed therein for frictionally and resiliently engaging said poppet plunger.

* * * * *